US008635781B2

(12) United States Patent
Fischer

(10) Patent No.: US 8,635,781 B2
(45) Date of Patent: Jan. 28, 2014

(54) DUAL-BLADE FILM-CUTTING DEVICE

(75) Inventor: Sebastian Fischer, Ashland, OH (US)

(73) Assignee: Liqui-Box Corporation, Worthington, OH (US)

( * ) Notice: Subject to any disclaimer, the term of this patent is extended or adjusted under 35 U.S.C. 154(b) by 723 days.

(21) Appl. No.: 12/707,269

(22) Filed: Feb. 17, 2010

(65) Prior Publication Data

US 2010/0205812 A1 Aug. 19, 2010

Related U.S. Application Data

(60) Provisional application No. 61/153,784, filed on Feb. 19, 2009.

(51) Int. Cl.
*B26B 3/00* (2006.01)

(52) U.S. Cl.
USPC ..... 30/304; 30/305

(58) Field of Classification Search
USPC ..... 30/162–164, 304, 305
See application file for complete search history.

(56) References Cited

U.S. PATENT DOCUMENTS

| | | | | | |
|---|---|---|---|---|---|
| 939,846 | A | * | 11/1909 | Matthews | 30/304 |
| 1,649,318 | A | * | 11/1927 | Miller | 30/304 |
| 1,739,214 | A | * | 12/1929 | Darling | 30/304 |
| 1,890,506 | A | * | 12/1932 | Frank et al. | 30/162 |
| 1,903,789 | A | * | 4/1933 | Michaels | 30/304 |
| 1,991,546 | A | * | 2/1935 | Czapar, Jr. | 30/304 |
| 2,198,111 | A | * | 4/1940 | Gorbatenko et al. | 30/162 |
| 2,232,321 | A | * | 2/1941 | Gibson | 30/162 |
| 2,291,514 | A | * | 7/1942 | Warner et al. | 30/162 |
| 2,364,339 | A | * | 12/1944 | Becker | 30/304 |
| 2,448,383 | A | * | 8/1948 | Mathaus | 30/304 |
| 2,464,206 | A | * | 3/1949 | Becker | 30/304 |
| 2,474,609 | A | * | 6/1949 | Wolf | 30/162 |
| 2,601,723 | A | * | 7/1952 | Keller | 30/162 |
| 3,045,348 | A | * | 7/1962 | Dungan | 30/304 |
| D205,286 | S | * | 7/1966 | Dyment et al. | D8/98 |
| 3,999,290 | A | * | 12/1976 | Wood | 30/162 |
| 4,288,921 | A | * | 9/1981 | Rhynes | 30/304 |
| 4,472,879 | A | * | 9/1984 | Sizemore, Jr. | 30/304 |
| 4,558,517 | A | * | 12/1985 | Gringer | 30/162 |
| 4,578,865 | A | | 4/1986 | Keller | |
| 4,715,121 | A | * | 12/1987 | Sugiyama et al. | 30/162 |
| 4,769,912 | A | * | 9/1988 | Davis | 30/162 |
| 4,791,725 | A | * | 12/1988 | Amagaya | 30/162 |

(Continued)

FOREIGN PATENT DOCUMENTS

| | | | | |
|---|---|---|---|---|
| CA | 2752329 | A1 | * | 8/2010 |
| WO | WO 2010/096454 | A1 | * | 8/2010 |

OTHER PUBLICATIONS

The International Search Report and Written Opinion of the International Searching Authority, Application No. PCT/US2010/024436, Mailed May 21, 2010.

*Primary Examiner* — Jason Daniel Prone
(74) *Attorney, Agent, or Firm* — Potter Anderson Corroon LLP; Rakesh H. Mehta, Esq.

(57) ABSTRACT

This invention relates to a dual-blade cutting device used for cutting strips from films and sheets. Particularly, in the cutting device of the invention, the blades are not exposed to the outside during the non-use position. Also, in the use position, the exposure is minimal to the operator. Therefore, using the cutting device of the invention renders the operation safe for the cutting operator.

16 Claims, 8 Drawing Sheets

(56) References Cited

U.S. PATENT DOCUMENTS

| | | | | | |
|---|---|---|---|---|---|
| 5,208,983 | A * | 5/1993 | Masse | 30/162 |
| 5,337,481 | A * | 8/1994 | Mears | 30/162 |
| 5,377,413 | A * | 1/1995 | Masse | 30/162 |
| 5,433,004 | A * | 7/1995 | Thompson et al. | 30/339 |
| 5,447,516 | A * | 9/1995 | Gardner | 30/304 |
| 5,584,123 | A * | 12/1996 | Chi | 30/162 |
| 5,617,635 | A * | 4/1997 | Berns | 30/162 |
| D418,036 | S * | 12/1999 | Shearer | D8/98 |
| 6,029,355 | A * | 2/2000 | Carlin | 30/304 |
| 6,101,721 | A * | 8/2000 | Medhurst | 30/162 |
| 6,148,520 | A * | 11/2000 | Berns | 30/162 |
| 6,308,422 | B1 | 10/2001 | MacDonal | |
| 6,418,624 | B1 * | 7/2002 | Huang | 30/162 |
| 6,427,569 | B2 * | 8/2002 | MacDonald | 30/304 |
| 6,550,144 | B1 * | 4/2003 | Berns | 30/162 |
| 6,553,673 | B2 * | 4/2003 | Peyrot et al. | 30/162 |
| D499,629 | S * | 12/2004 | Alvarez | D8/99 |
| 6,887,250 | B1 * | 5/2005 | Dority et al. | 30/305 |
| 7,255,705 | B2 * | 8/2007 | Hsu et al. | 30/304 |
| 7,596,868 | B2 * | 10/2009 | Berns | 30/162 |
| 7,596,869 | B2 * | 10/2009 | Berns | 30/162 |
| 7,603,779 | B2 * | 10/2009 | Rowlay | 30/162 |
| 7,900,362 | B2 * | 3/2011 | Djordjevic et al. | 30/162 |
| 8,065,945 | B2 * | 11/2011 | Kobayashi et al. | 30/304 |
| 2003/0136005 | A1 | 7/2003 | Panfili et al. | |
| 2003/0159290 | A1 * | 8/2003 | Berns | 30/162 |
| 2004/0055165 | A1 * | 3/2004 | Chan | 30/305 |
| 2006/0130338 | A1 * | 6/2006 | Dzubak et al. | 30/162 |
| 2010/0132199 | A1 * | 6/2010 | Ruan | 30/162 |

* cited by examiner

305

310

315

320

DUAL-BLADE FILM-CUTTING DEVICE

CROSS-REFERENCE TO RELATED APPLICATION

This application claims the benefit of U.S. Provisional Application No. 61/153,784 which was filed Feb. 19, 2009, of which is incorporated by reference herein in its entirety.

FIELD OF INVENTION

This invention relates to a dual-blade cutting device used for cutting strips from films and sheets. Particularly, in the cutting device of the invention, the blades are not exposed to the outside during the non-use position. Also, in the use position, the exposure is minimal to the operator. Therefore, using the cutting device of the invention renders the operation safe for the cutting operator.

BACKGROUND

Devices for cutting films and sheets generally use single blades or cutting means such as scissors. It is difficult to cut films or sheets of exact dimensions with such cutting means. Particularly, it is problematic to cut sample sizes of consistent width. For example, periodic samples from film production lines for subsequent physical properties' testing (for example, tensile testing) must have a standardized width. A consistent width of sample is required for accurately comparing and measuring its tensile properties.

In addition, the cutting process should take minimum possible time. Cutting means, such as scissors, however take time to prepare accurately-sized samples.

On the other hand, in current dual-blade cutting devices—whether in use or not—blades are always exposed on the outside of the device. The device, therefore, becomes inherently dangerous for the user.

Thus, a need exists for a cutting device that quickly and safely cuts film samples of uniform width. The cutting device of the present invention addresses the problems described above.

SUMMARY OF THE INVENTION

This invention relates to a cutting device, comprising:

(A) a bottom component comprising a head and a handle, wherein said bottom component has an inside wall and an outside wall; and (B) a top component comprising a head and a handle, wherein said top component has an inside wall and an outside wall, and wherein said top component is slidably attached to said bottom component;

wherein said top component is flat on the outside and has depth on the inside, said depth being formed by a wall at the edges of said top component;

wherein said top component comprises two blades removably and immovably attacked on the inside of the side walls on either side of said head of said top component;

wherein said top component further comprises receiving means for slidably attaching said top component with said bottom component;

wherein said bottom component is flat on the outside and has a depth on the inside, said depth being formed by a wall at the edges of said bottom component;

wherein said bottom component comprises supplying means for slidably attaching said top component with said bottom component; and wherein said bottom component further comprises a block on the inside of said head of said bottom component, such that said block forms channels between its side wall and said inside wall of said head of said top component, said channels helping guide said blades during forward and backward movement of said top component over said bottom component, wherein said block is optionally removably-mounted on the inside of said head of said bottom component.

In one embodiment of the invention, the cutting device described above, further comprises means for maintaining contracting tension between said top component and said bottom component when said top component is slidably extended for the blades to be used.

In another embodiment of the invention, in the cutting device as recited above, said top component and said bottom component are T-shaped.

In yet another embodiment of the invention, in the cutting device described above, said top component and said bottom component are rectangular-shaped.

In one embodiment of the invention, in the cutting device described above, said two blades are at an orientation angle to the plane of said top component in the range of from about 70° to 110°.

In yet another embodiment of the invention, in the cutting device described above, said orientation angle is substantially about 90°.

In another embodiment of the invention, in the cutting device described above, at least one blade of said two blades has the edge selected from the group consisting of straight edge, curved edge, serrated edge and pointed edge.

DETAILED DESCRIPTION OF THE INVENTION

Figure 1:
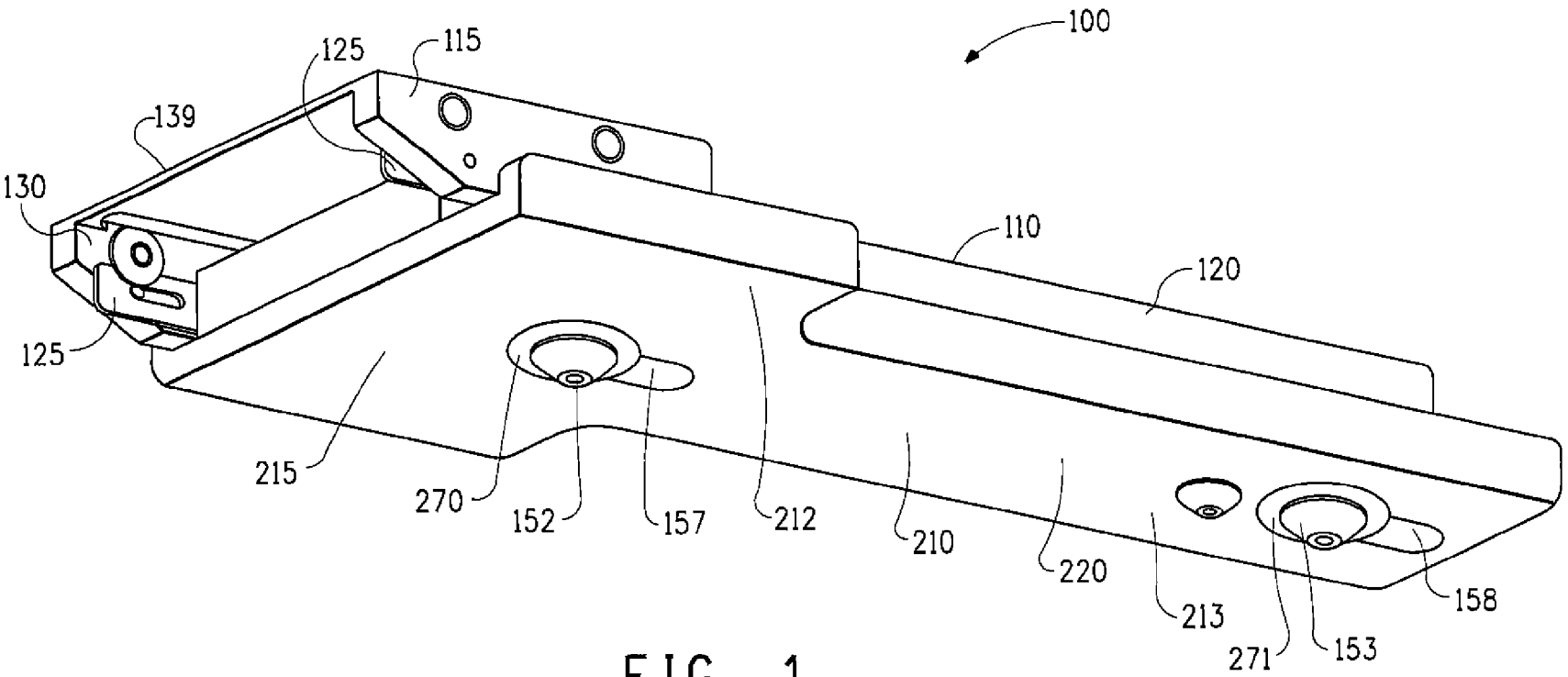
FIG. 1 shows the schematic of one embodiment of a T-shaped cutting device in perspective view.

The present invention relates to a device for cutting strips, for example, from plastic films or sheets, paper sheets, cloth, rubber or leather.

Unless otherwise defined, all technical and scientific terms used herein have the same meaning as commonly understood by one of ordinary skill in the art to which this invention belongs. In case of conflict, the present specification, including definitions, will control.

Although methods and materials similar or equivalent to those described herein can be used in the practice or testing of the present invention, suitable methods and materials are described herein.

When an amount, concentration, or other value or parameter is given as either a range, preferred range or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

When the term "about" is used in describing a value or an end-point of a range, the disclosure includes the specific value or end-point referred to.

The materials, methods, and examples herein are illustrative only and, except as specifically stated, are not intended to be limiting.

Generally, the present invention relates to a device for cutting strips of plastic films or sheets, paper, cloth, rubber or leather. The cutting device uses two blades. Because the distance between the blades is fixed and the blades themselves are immovable, an operator can easily cut strips of consistent width. The device is either in an "open" position or a "closed" position. In the "open" position, which is when an operator applies slidable force on one part of the cutting device, the blades become exposed for cutting. Once the slidable force is removed, the blades recess automatically, which corresponds to the "closed" or non-use position of the device. The blades are exposed only when the device is in use and when the operator imposes positive slidable force on the cutting device. Because the blades are concealed in the "closed" position, the cutting device is safer than other alternatives. In fact, even when the cutting device is in an "open" position, the blades are exposed in such manner that the slidable part shields over the blade from one side, in that, only a necessary portion of the blade is exposed, rendering the device operationally safe.

In one embodiment, the present invention relates to a cutting device, comprising:

(A) a bottom component comprising a head and a handle, wherein said bottom component has an inside wall and an outside wall; and (B) a top component comprising a head and a handle, wherein said top component has an inside wall and an outside wall, and wherein said top component is slidably attached to said bottom component;

wherein said top component is flat on the outside and has depth on the inside, said depth being formed by a wall at the edges of said top component;

wherein said top component comprises two blades removably and immovably attached on the inside of the side walls on either side of said head of said top component;

wherein said top component further comprises receiving means for slidably attaching said top component with said bottom component;

wherein said bottom component is flat on the outside and has a depth on the inside, said depth being formed by a wall at the edges of said bottom component;

wherein said bottom component comprises supplying means for slidably attaching said top component with said bottom component; and wherein said bottom component further comprises a block on the inside of said head of said bottom component, such that said block forms channels between its side wall and said inside wall of said head of said top component, said channels helping guide said blades during forward and backward movement of said top component over said bottom component, wherein said block is optionally removably-mounted on the inside of said head of said bottom component.

The blades are removably and immovably attached on the inside of the side walls on either side of said head of said top component. By "removably attached" is meant that the blades can be removed for polishing and can be remounted or new blades can be mounted in place of the removed blades. By "immovably attached" is meant that once the blades are mounted, there is no substantial movement of the blades relative to the top component of the cutting device. The forward or the backward movement if the blades for cutting purposes is accomplished by the forward or backward movement of the top component. Stated another way, while the blades can be removably attached to the top component, once the blades are mounted, the top component and the blades move as one unit without any substantial relative movement.

Figure 6:
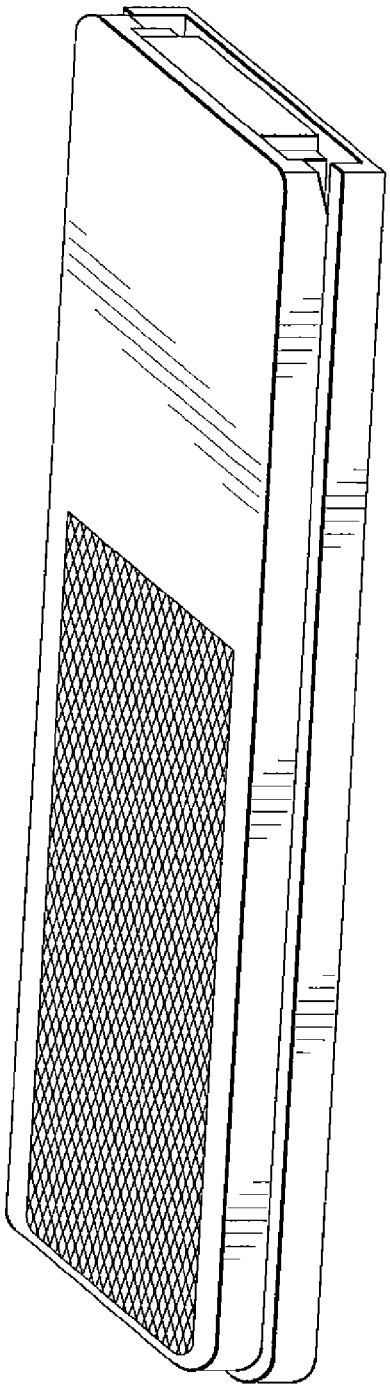
FIG. 6 shows a perspective view of a rectangular-shaped the cutting device.
Figure 7:
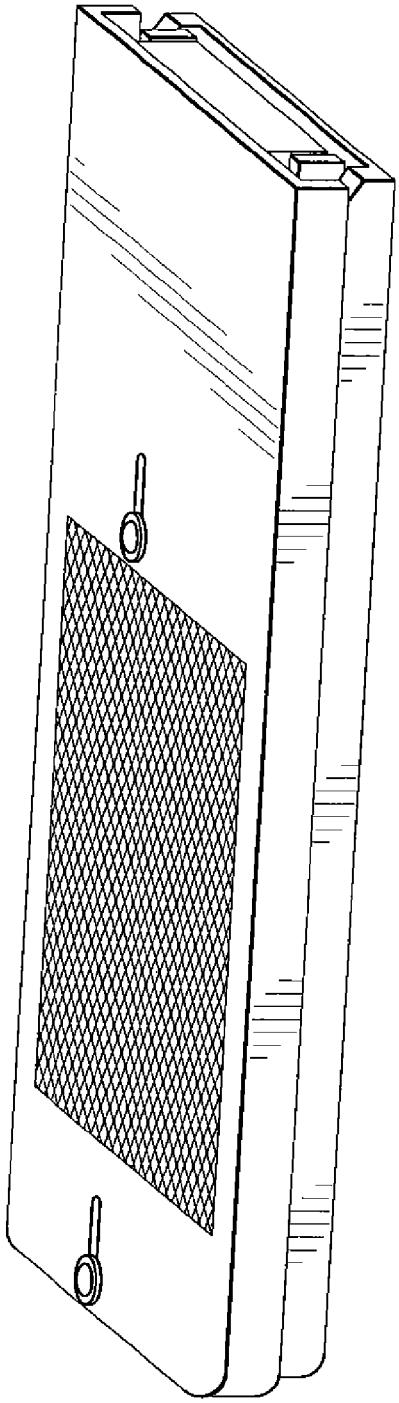
FIG. 7 shows another perspective view of the FIG. 6 embodiment, wherein the cutting device is rectangular-shaped.

In one embodiment, said top component and said bottom component described above are T-shaped. In another embodiment, said top component and said bottom component described above are rectangular-shaped. FIGS. 1-5 below describe an embodiment of the present invention that is in a T-shaped configuration. FIGS. 6 and 7 show an embodiment of the present invention wherein the shape of the cutting device is rectangular. The invention is described infra in terms of a T-shaped cutting device. The description of substantive features that relate to the T-shaped cutting device also applies to the rectangular-shaped cutting device.

Generally, the cutting device of the present invention can have varying widths (as measured by the width between the two blades). In one embodiment of the present invention, the cutting device width is in the range of from about 5 mm to about 25 cm. Preferably the width is in the range of from about 10 mm to about 13 cm. In a further preferred range the width is in the range of from about 2.5 cm to 6 cm. In a preferred embodiment, the width is 2.54 cm (1 inch) or 5.1 cm (2 inches).

FIG. 1 shows a perspective view of one embodiment of the cutting device (100) of the present invention. The cutting device (100) comprises of two T-shaped components, the top T-shaped component (110) and the bottom T-shaped component (210). The top T-shaped component (110) comprises of head (115) and a handle (120). Similarly, the bottom T-shaped component (210) comprises a head (215) and a handle (220).

As shown in FIG. 1, the two T-shaped components are slidably attached to each other by attachment means such as a first button-head screw (152) through a first guide slot (157) shown on the outside wall (212) of the head (215) of the bottom T-shaped component (210), and a second button-head screw (153) through a second guide slot (158) shown on the outside wall (213) of the handle (220) of the bottom T-shaped component (210). Optionally, a washer (270 and 271) is placed in between said first button-head screw (152) and said first guide slot (157) and/or between said second button-head screw (153) and said second guide slot (158). The washer is preferably made from PTFE. The attachment means, that is, the button-head screws (152 and 153) are received by the receiving attachment means (not shown) on the inside wall (not shown) of the top T-shaped component (no), which are described in the ensuing disclosure. The top T-shaped component (110) can move relative to the bottom T-shaped component (210) in a plane parallel to the plane of the bottom T-shaped component (210), that is, in a shear direction. The movement does not impact the attachment of the two components, as the components are slidably attached.

The top T-shaped component (110) also houses two blades (125) attached to the inside of the lateral walls (130) of the head (115). FIG. 1 shows the cutting device in its "open" position. In the "open" position, the blades are exposed for cutting. As can be seen from FIG. 1, although the blades (125) are exposed and available for cutting, the proximal end (139) of the head (115) of the top T-shaped component (110) covers the blade in such manner that the exposure of the blades (125) is limited to what is necessary for cutting. An operator using the cutting device will have minimal exposure to the blades (125).

Figure 9:
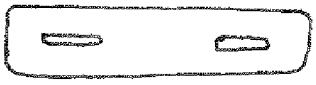
FIG. 9 shows a frontal view of four different cutting blades that are used in the cutting device.
Figure 9:
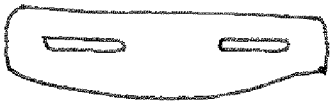
Figure 9:
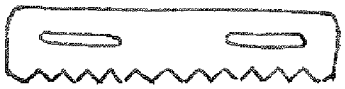
Figure 9:
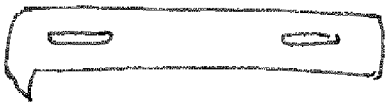

The blades can be of many shapes as shown in FIG. 9. For example, as shown in FIG. 9, the blade can be straight-edged (305), serrated-edged (315), curved edged (310) or pointed-edged (320).

The Top T-Shaped Component

Figure 2:
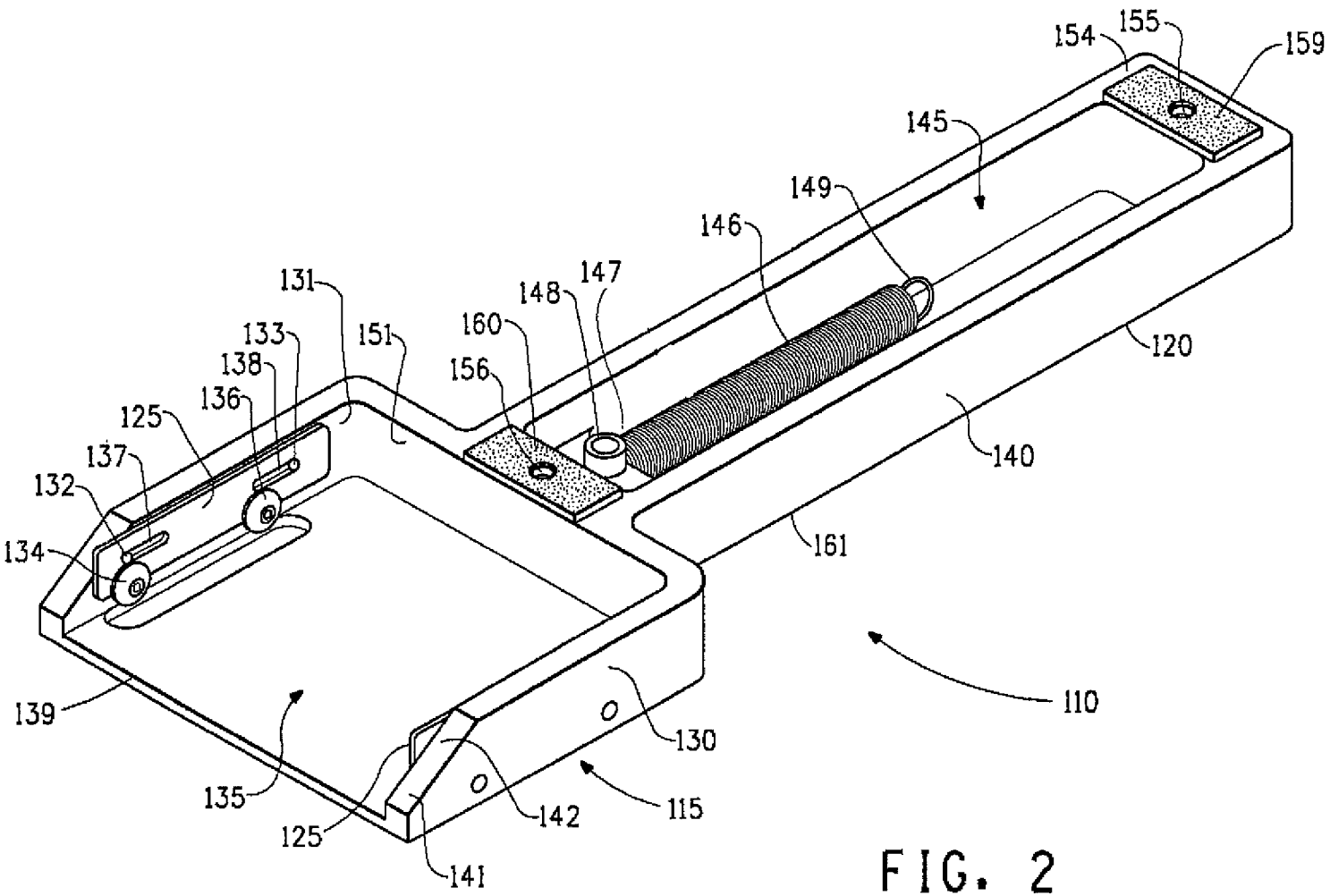
FIG. 2. shows the schematic of the top T-shaped component.

FIG. 2 shows a perspective view of the inside of the top T-shaped component (110). The top T-shaped component (110) comprises of a head (115) and a handle (120). The top T-shaped component (110) forms a hollow cavity (135) in the head (115) by virtue of the head's (115) lateral walls (130), and a hollow cavity (145) in the handle (120) by virtue of the handle's (120) lateral wall (140).

The head (115) houses two blades (125) mounted on inside wall (131) of the lateral walls (130) of the head (115) and within its hollow cavity (135). The blades (125) are mounted in such manner that the blade (125)'s plane is perpendicular to the plane of the top T-shaped component (110). The blades are attached to the lateral walls (130) by means of two blade positioning pins (132 and 133). The positioning pins (132 and 133) ensure that the blades are immovably mounted on the walls, with a negligible movement relative to the axial or transverse direction of the head (115), even in the open position. The blades (125) are removably-mounted to the inside wall (131) of the lateral wall (130) of the head (115)'s hollow cavity (135) by attachment means, such as two button-head screws (134 and 136). Optionally, a washer (not shown) can be placed in between the button-head screws (134 and 136) and the blade (125). The washer can help reduce absorb the beading force on the blade during operation.

Figure 8:
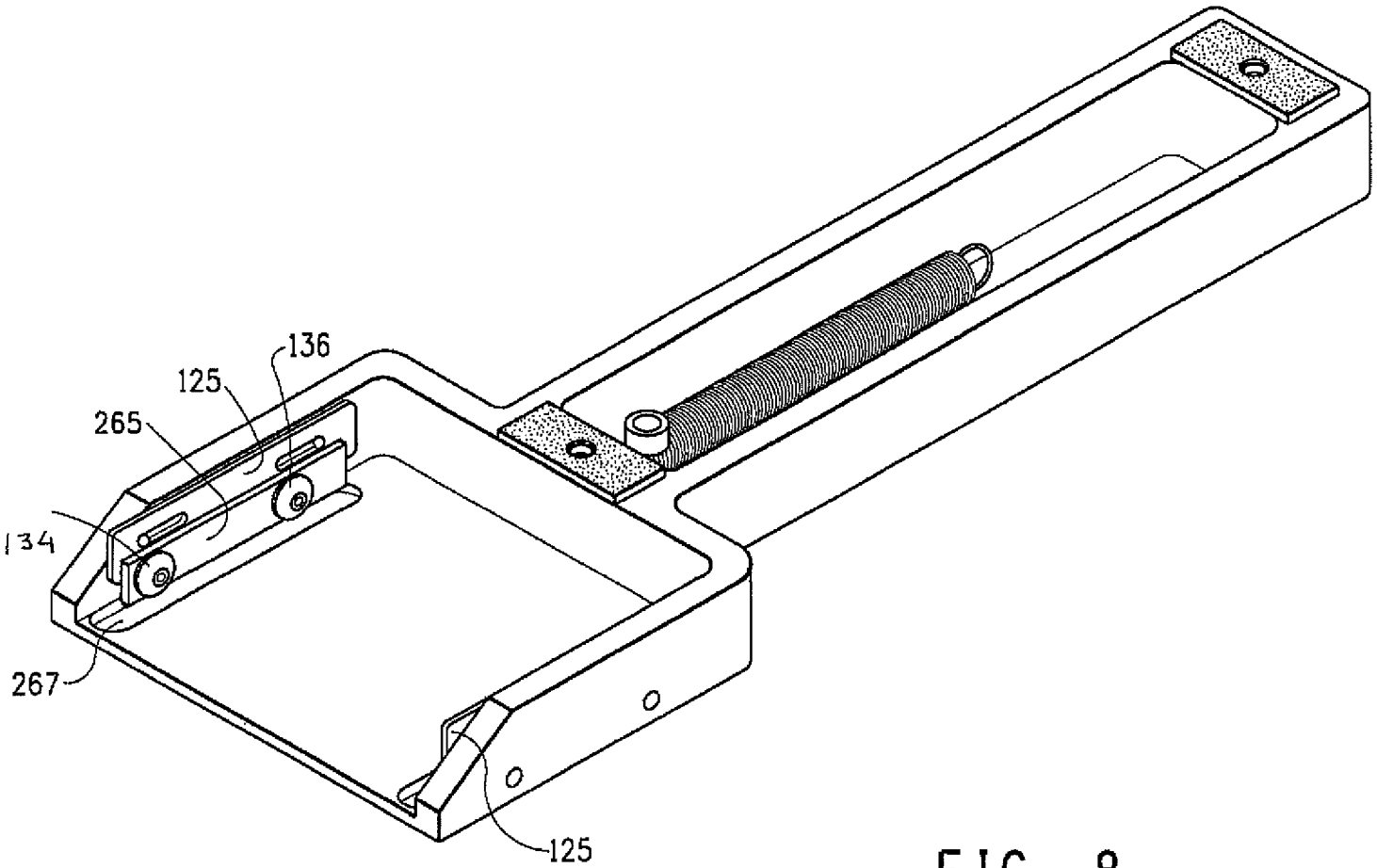
FIG. 8 shows the schematic of top T-shaped component with optional rectangular shaped washers between the cutting blade and the button-head screws.

As shown in FIG. 8, a rectangular washer (265) is placed between the button-head screws (134, 136) and the blade (125). Optionally, to accommodate the washer rectangular or otherwise a small slot (267) is milled on the inside wall of the hollow cavity (135) of the head (115) of the top T-shaped component (110). The button-head screws (for example, 134 and 136) hold the blade (125) in place. Since the surface area of the screws is small, blades can bend and fracture. The washer, placed on one or both blades helps distribute the force during operation, thereby ensuring longevity of the blade.

In one embodiment, the blades (125) have two axial slots (137 & 138) that serve to accommodate the blade positioning pins (132 and 133). The proximal end (141) of the lateral walls (130) forming the hollow cavity (135) show a gradual slope (142) up to the proximal end (139) of the head (115) of the top T-shaped component (110). This gradual slope (142) provides for the exposure of the blades (125) when the top T-shaped component (110) is in slidably "open" position relative to bottom T-shaped component (210). As it is seen in FIG. 2, only a small portion of the blades (125) protrudes outside the gradual slope (142) of the lateral walls (130) of the head (115).

The handle (120) or stem of the top T-shaped component (110) comprises a hollow cavity (145) with lateral walls (140). Inside the hollow cavity is housed the means for providing contracting tension between the top T-shaped component (110) and the bottom T-shaped component (not shown). Generally, means such as a spring or stretchable rubber cord can be used. In the embodiment of FIG. 2, an extension spring (146) is used. The extension spring is fastened on one end (147) to a socket head screw (148). The other end (149) is fastened to similar socket head screw of the bottom T-shaped component (not shown). The extension spring (146) maintains tension between the top (110) and the bottom T-shaped components. The tension increases when the top T-shaped component (110) is pushed slidably away from the bottom T-shaped component. The spring tension serves to retain the "closed" position as default position for the cutting device. The spring tension also serves to eliminate any play between the top (110) and the bottom T-shaped components when the cutting device is in "open" position.

Further as shown in FIG. 2, the hollow cavity (145) of the handle (120) is not contiguous with the hollow cavity (135) of the head (115) of the top T-shaped component (110) of the cutting device (100). The two cavities are separated by a transverse wall (151). The transverse wall (151) and the handle's back-wall (154) each have a centrally-located socket or a threaded hole (155 and 156) for receiving attachment means such as button-head screws (not shown) affixed from the outside wall of the bottom T-shaped component (not shown) of the cutting device (100). On the transverse wall (151) and the handle's back-wall (154)—and corresponding to the threaded holes (155 and 156)—are placed two polyethylene or other such plastic tapes (159 and 160) with circular holes corresponding to the threaded holes (155 and 156). The plastic tapes (159 and 160) serve to maintain snug contact between the top T-shaped component (110) and the bottom T-shaped component (not shown) and at the same time serves to reduce any friction in shear direction when the top T-shaped component (110) slidably moves relative to the bottom T-shaped component (not shown).

Figure 3:
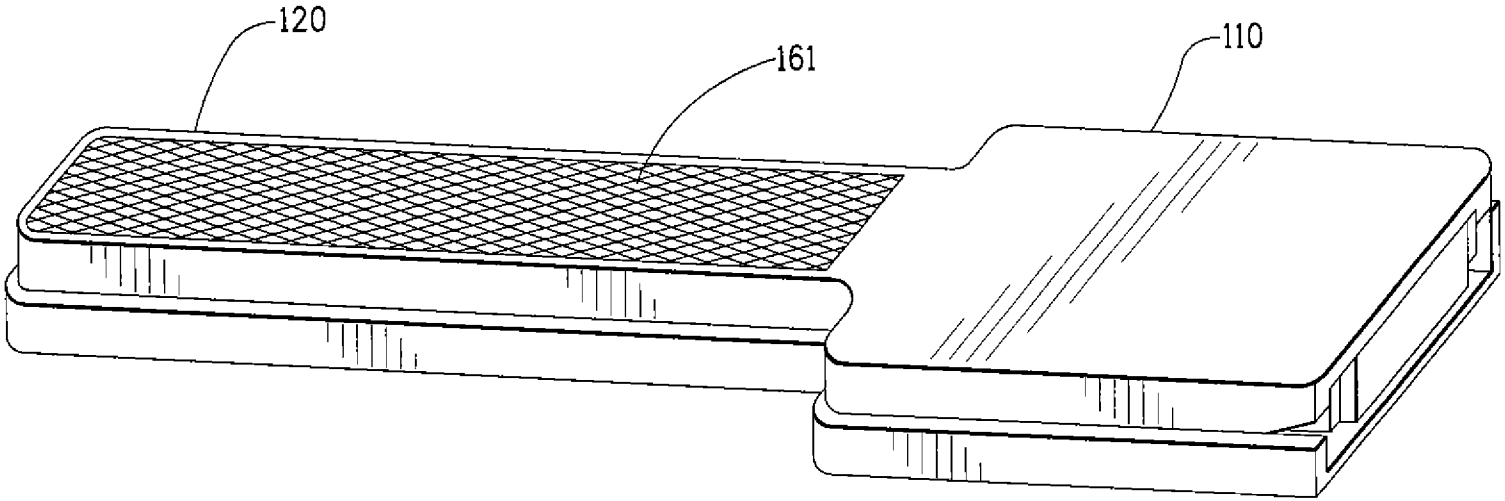
FIG. 3 shows a perspective view of the T-shaped cutting device displaying the top view of the top T-shaped component.

As shown in FIG. 3, the outside wall (161) of the handle (120) of the top T-shaped component (110) can have smooth surface. However, to generate better grip while operating the cutting device, the surface may be knurled or imposed with an embossed pattern, which will provide sufficient surface roughness to afford a good grip. On the other hand, instead of a knurled surface, the outside wall can have rubber sheet attached, which will serve the same function. The rubber sheet can optionally have a pattern on its surface to provide additional grip to the operator.

The Bottom T-Shaped Component

Figure 4:
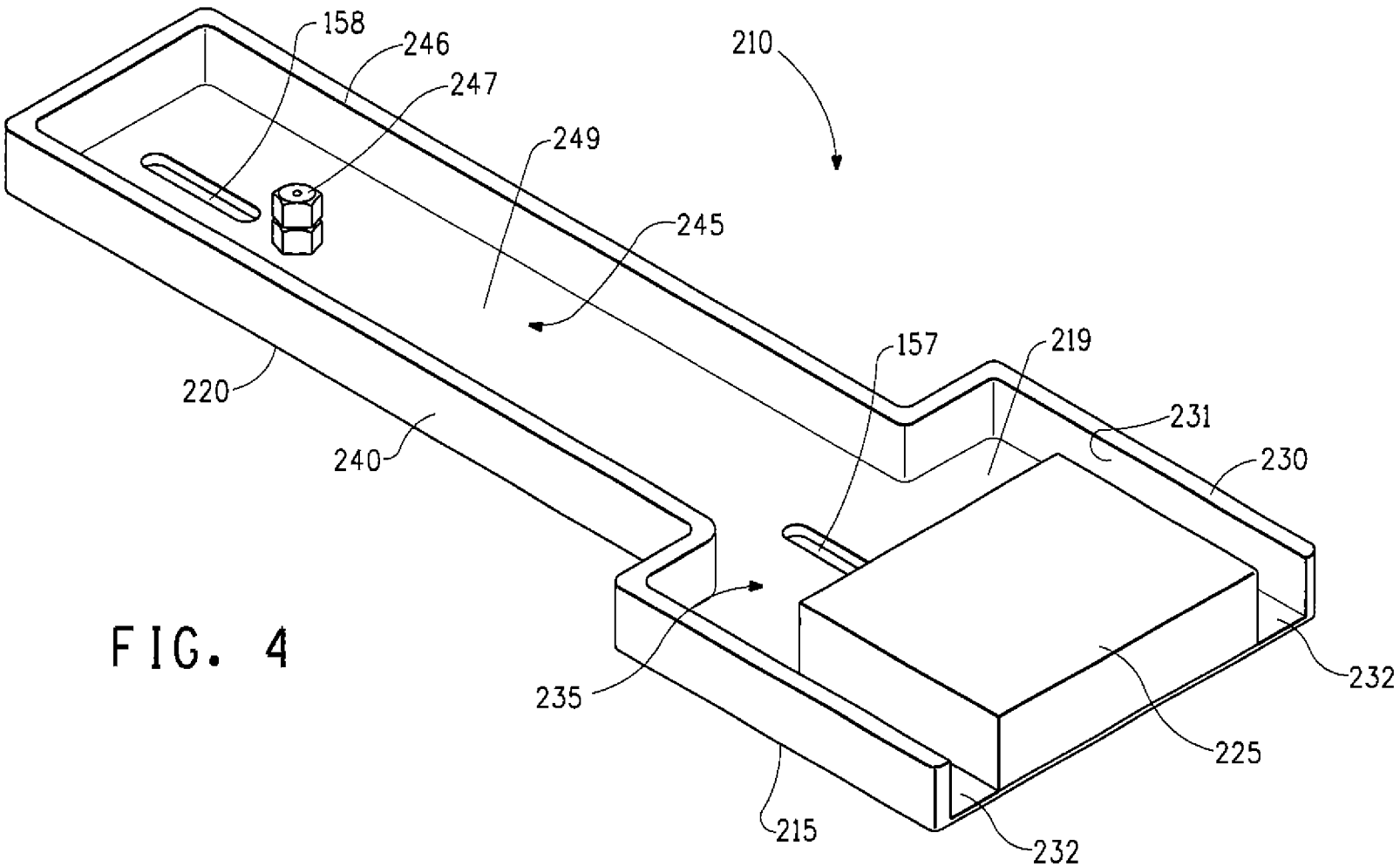
FIG. 4 shows the schematic of the bottom T-shaped component.

FIG. 4 shows the perspective view of the inside of bottom T-shaped component (210) of the cutting device (100). The bottom T-shaped component (210) comprises of a head (215) and a handle (220). The bottom T-shaped component (210) forms a hollow cavity (235) in the head (215) by virtue of the head's (215), lateral walls (230), and a hollow cavity (245) in the handle (220) by virtue of the handle's (220) lateral wall (240).

In one embodiment, as shown in FIG. 4, the head (215) houses a block (225) mounted on the floor (219) of the head (215), in such manner that the block (225) and the inside wall (231) of the lateral walls (230) of the head (215) form channels (232) on either side of the block (225). The block (225) can be removably-mounted or can be milled as one piece along with the bottom T-shaped component (210). These channels (232) provide space for the top T-shaped component (not shown) to easily move slidably in and out in the shear direction relative to the bottom T-shaped component (210). Generally speaking, the top T-shaped component is narrower in width compared to the bottom T-shaped component (210).

As a result, the lateral wall of the head (115) of the top T-shaped component, as well as the blades (125), reside within the two channels (232) of the bottom T-shaped component (210), when in "closed" position and move axially to the channels (232) to arrive at the "open" position. The head (215) of the bottom T-shaped component (210) has the first guide slot (157) on its floor (219), that corresponds to the attachment means such as a button-head screw that passes through the first guide slot (157) and into the corresponding centrally-located socket or threaded hole of the top T-shaped component (not shown). The slot allows for the shear movement of the top T-shaped component relative to the bottom T-shaped component (210).

The handle (220) or handle of the bottom T-shaped component (210) comprises a hollow cavity (245) with lateral walls (246). Inside the hollow cavity (245) are two lock nuts (247) placed along the central axis of the handle (220). The lock nuts serve to fasten one end of the means for providing contracting tension, such as an extension spring (not shown; but see discussion supra). As discussed previously the extension spring maintains tension between the top and the bottom T-shaped components (no and 210). The tension increases when the top T-shaped component (110) is pushed slidably away from the bottom. T-shaped component (210). At the far end of the handle (220), and along its longitudinal axis, is a second guide slot (158) on the floor (249) of the handle (220). The second guide slot (158) corresponds to the attachment means such as a button-head screw that passes through the second guide slot (158) and into the corresponding centrally-located socket or threaded hole of the top T-shaped component (not shown). The second guide slot (158), along with the first guide slot (157), allows for the shear movement of the top T-shaped component relative to the bottom T-shaped component (210). In the embodiment described herein (although not limiting), the handle (220) of the bottom T-shaped component (210) is wider than the handle (120) of the top T-shaped component (110), such that the handle (120) of the top T-shaped component (110) snugly fits within the handle (220) of the bottom T-shaped component (210), similar to the fitting of the heads (115 and 215) of the two components (no and 210).

Figure 5:
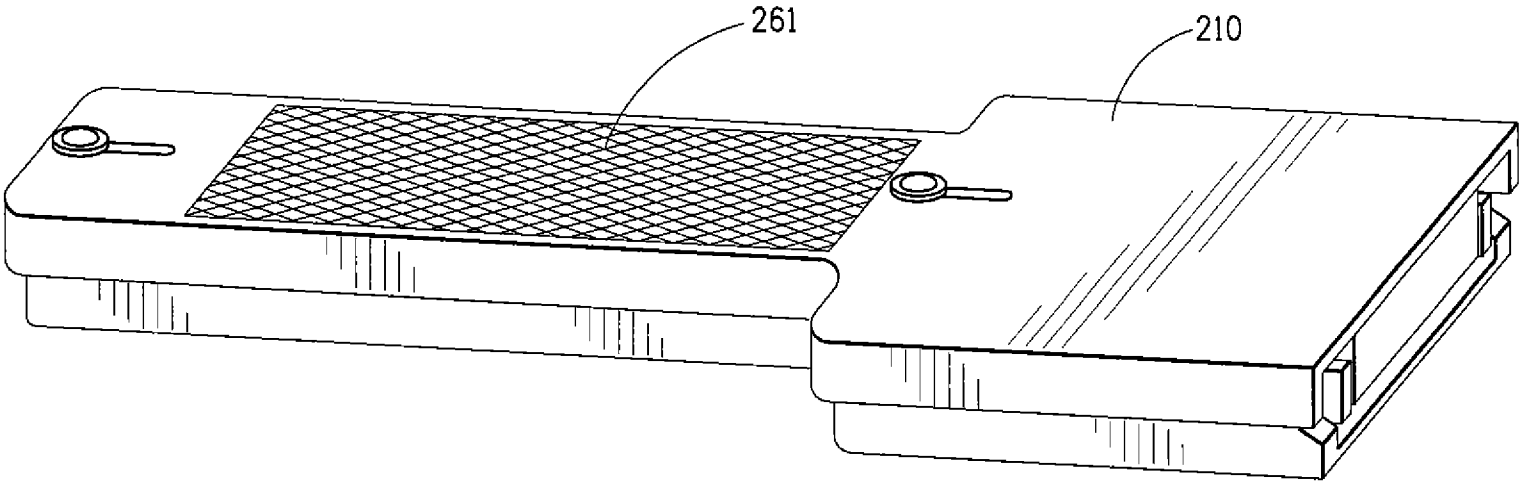
FIG. 5 shows another perspective view of the T-shaped cutting device displaying the bottom view of the bottom T-shaped component.

As shown in FIG. 5 the outside wall (261) of the handle (220) of the bottom T-shaped component (210) can have smooth surface. However, to generate better grip while operating the cutting device, the surface may be knurled or imposed with an embossed pattern, which will provide sufficient surface roughness to afford a good grip. On the other hand, instead of a knurled surface, the outside wall can have rubber sheet attached, which will serve the same function. The rubber sheet can optionally have a pattern on its surface to provide additional grip to the operator.

In one embodiment, in the cutting device as recited in the previously described embodiments, the two blades are oriented at angle to the plane of said top component in a range of from about 70° to 110°. In another embodiment, the orientation angle is about 90°.

When the cutting device is to be used, the operator holds the device in one hand, with the thumb on the outside wall of the handle of the top T-shaped component, and the fingers on the outside wall of the handle of the bottom T-shaped component. With the thumb, the operator pushes the top T-shaped component forward. The top T-shaped component moves forward, and the two blades are exposed. The top T-shaped component has a tendency to recoil back to the "closed" position owing to the contracting tension provided by the extension spring. This tension also serves to maintain the relative positions of the two components, that is, without any relative movement when a sample is being cut. This avoids improper cutting of the sample, and at the same time, serves to conduct the cutting operation in a safe manner.

With this instrument, one can generally cut sheets. For example plastic sheets, foils, paper, rubber, cloth and leather can be cut for sampling purposes. The advantage of the cutting device is that the sample size is constant. The instrument can be made such that a sample size as small as 0.5 inches to as large as 6 inches can be cut with the cutting device.

FIGURE KEYS

FIG. 1
100 cutting device
110 top T-shaped component
115 top T-shaped component head
120 top T-shaped component handle
125 two blades
130 lateral walls of the head
139 the proximal end of the head
152 first button-head screw
153 second button-head screw
157 first guide slot
158 second guide slot
210 bottom T-shaped component
212 outside wall of the head
213 outside wall of the handle
215 bottom T-shaped component head
220 bottom T-shaped component handle
270 washer between first button-head screw and first guide slot
271 washer between second button-head screw and second guide slot FIG. 2
110 top T-shaped component
115 top T-shaped component head
120 top T-shaped component handle
125 two blades
130 lateral walls top head
131 inside wall of the lateral walls
132 & 133 blade positioning pins
134 & 136 two button-head screws
135 hollow cavity head
137& 138 two axial slits
139 proximal end of the head
140 handle's lateral wall
141 proximal end of the lateral walls
142 gradual slope
145 hollow cavity in the handle
146 extension spring
147 extension spring as fastened on one end
148 socket head screw
149 other end of the spring
151 transverse wall
154 handle's back-wall
155 & 156 threaded holes
159 & 160 two polyethylene or other such plastic tapes
161 outside wall of the handle FIG. 3
110 top T-shaped component
120 top T-shaped component handle
161 outside wall of the handle FIG. 4
215 bottom T-shaped component head
157 first guide slot
219 floor
220 the handle of the bottom T-shaped

225 block
230 head's lateral walls
231 inside wall
232 channels on either side of the block
235 hollow cavity in the head of the bottom T-shaped component
240 handle's lateral wall
245 hollow cavity
246 lateral walls
247 two lock nuts
249 floor of the handle
158 second guide slot
FIG. 5
210 bottom T-shaped component
261 outside wall of the handle
FIG. 6
None
FIG. 7
None
FIG. 8
265 washer
267 slot
134 first button-head screw
136 second button-head screw
125 two blades
FIG. 9
305 straight-edged
310 curved-edged
315 serrated-edged
320 pointed-edged

The invention claimed is:

1. A cutting device, comprising:

(A) a top component; and (B) a bottom component;

wherein said top component comprises a head part and a handle part, wherein said top component has a top surface and a bottom surface, wherein said bottom surface is comprised of a base defining a first cavity and a base defining a second cavity, wherein said first cavity having a distil end and a proximal end is under said head part and further defined by a vertically and longitudinally oriented first lateral wall, a vertically and transversely oriented second wall, and a vertically and longitudinally oriented third lateral wall, said each wall having a surface inside said first cavity and a surface outside said first cavity, with said first cavity being open at said cavity's proximal end, wherein said second wall is perpendicularly disposed to said first lateral wall and said third lateral wall, wherein said second wall connects said first lateral wall and said third lateral wall, wherein said second wall, which is at the distal end of said first cavity and proximal end of said second cavity, divides said first cavity from said second cavity, and wherein said inside surface of said first lateral wall and said inside surface of said third lateral wall, each have a removably-mounted cutting blade, wherein said second cavity is under said handle part further defined by a vertically and longitudinally oriented fourth lateral wall, a vertically and transversely oriented fifth lateral wall, a vertically and longitudinally oriented sixth lateral wall, and said second wall, wherein said second cavity having positioned therein a longitudinally placed spring comprising a first end and a second end, wherein said spring's first end is fastened to said proximal end of said second cavity in said top component and said spring's second end is fastened to said bottom component;

wherein said bottom component comprises a head part and a handle part corresponding to said head part and said handle part of said top component, respectively, wherein said bottom component has a top surface and a bottom surface, wherein said top surface of said bottom component is comprised of a base defining a third cavity, wherein said head part of said bottom component comprises of a proximal end and a distal end, and said handle part of said bottom component comprises of a proximal end and a distal end, and wherein said distal end of said head part is in connection with said proximal end of said handle part, wherein said third cavity having a base is further defined by a vertically and longitudinally oriented seventh lateral wall of said head part of said bottom component, a vertically and longitudinally oriented eighth lateral wall of said head part of said bottom component, said each wall having a surface inside said third cavity and a surface outside said third cavity, with said third cavity being open at the proximal end of said head part of said bottom component, wherein at the distal end of said head part of said bottom component, said third cavity extends into said handle of said bottom component, wherein said third cavity in said handle part is further defined by a vertically and longitudinally oriented ninth lateral wall of said handle part of said bottom component, a vertically and transversely oriented tenth lateral wall of said handle of said bottom component at the distal end of said handle, and a vertically and longitudinally oriented eleventh lateral wall of said handle part of said bottom component, wherein said ninth lateral wall and said eleventh lateral wall are connected to each other by said tenth lateral wall, wherein said bottom component further comprises a block in said third cavity within said head part of said bottom component, such that said block defines channels between the inside surface of said seventh lateral wall and the inside surface of said eighth lateral wall, wherein said channels help guide said blades during forward and backward movement of said top component over said bottom component, and wherein said third cavity comprises locknuts attached to the base at the distal end of said handle of said bottom component, wherein said locknuts serve to fasten said spring at the distal end to create tension between said top component and said bottom component when said top component is slidably moved away from said bottom component, wherein said top component is slidably attached to said bottom component.

2. The cutting device as recited in claim 1, wherein said top component and said bottom component are T-shaped.

3. The cutting device as recited in claim 2, wherein said two blades are at an orientation angle to a plane defined by said top component in a range of from about 70° to 110°.

4. The cutting device as recited in claim 3, wherein said orientation angle is about 90°.

5. The cutting device as recited in claim 2, wherein at least one blade of said two blades has the edge selected from a group consisting of straight edge, curved edge, serrated edge and pointed edge.

6. The cutting device as recited in claim 2, wherein a width of said cutting device is in a range of from about 5 mm to 25 cm.

7. The cutting device as recited in claim 2, wherein a width of said cutting device is in a range of from about 2.5 cm to about 6 cm.

8. The cutting device as recited in claim 7, wherein said two blades are at an orientation angle to a plane defined by said top component in a range of from about 70° to 110°.

9. The cutting device as recited in claim 7, wherein at least one blade of said two blades has the edge selected from a group consisting of straight edge, curved edge, serrated edge and pointed edge.

10. The cutting device as recited in claim 9, wherein a width of said cutting device is in a range of from about 2.5 cm to about 6 cm.

11. The cutting device as recited in claim 7, wherein a width of said cutting device is in a range of from about 5 mm to 25 cm.

12. The cutting device as recited in claim 1, wherein said top component and said bottom component are rectangular-shaped.

13. The cutting device as recited in claim 12, wherein said orientation angle is about 90°.

14. The cutting device as recited in claim 1, wherein said block is removably-mounted in said third cavity.

15. The cutting device as recited in claim 1, wherein said head part of said top component, said handle part of said top component, said head part of said bottom component, and said handle part of said bottom component are rectangular in shape.

16. The cutting device as recited in claim 1 wherein said handle part of said top component is narrower than said head part of said top component, and said handle part of said bottom component is narrower than said head part of said bottom component.

* * * * *